US005569101A

United States Patent [19]

O'Keeffe

[11] Patent Number: 5,569,101

[45] Date of Patent: Oct. 29, 1996

[54] GOLF BALL TEEING APPARATUS

[76] Inventor: John J. O'Keeffe, 83 GooseAcre, Botley Rd., Chesham, Bucks, HP5 1YQ, United Kingdom

[21] Appl. No.: 578,595

[22] PCT Filed: May 20, 1994

[86] PCT No.: PCT/GB94/01110

§ 371 Date: Jan. 4, 1996

§ 102(e) Date: Jan. 4, 1996

[87] PCT Pub. No.: WO94/27686

PCT Pub. Date: Dec. 8, 1994

[30] Foreign Application Priority Data

May 25, 1993 [GB] United Kingdom ..... 9310726

[51] Int. Cl.[6] ..... A63B 57/00

[52] U.S. Cl. ..... 473/390; 473/396; 473/137

[58] Field of Search ..... 473/132–137, 473/387, 390, 391, 392, 396, 397, 278, 279

[56] References Cited

U.S. PATENT DOCUMENTS

| | | | |
|---|---|---|---|
| 1,173,792 | 2/1916 | Fuchs | 473/390 |
| 1,525,588 | 2/1925 | Moore | 473/392 |
| 1,779,995 | 10/1930 | Trane | 473/390 |
| 2,127,282 | 8/1938 | Beckett | 473/137 |
| 2,198,968 | 4/1940 | Jewett | 473/137 |
| 2,450,206 | 9/1948 | Shouse | 473/137 |
| 2,711,321 | 6/1955 | McGraw, Sr. | 473/137 |

FOREIGN PATENT DOCUMENTS 2224216 5/1990 United Kingdom .

*Primary Examiner*—Steven B. Wong
*Attorney, Agent, or Firm*—Walter C. Farley

[57] ABSTRACT

A golf teeing apparatus comprises two movable carriers (7) each of which supports a flexible rubber tee (17) and a rocker arm (12) which connects the carriers and allows alternate up and down movement thereof. The arrangement facilitates the action of teeing and is intended to have utility in golf driving ranges.

9 Claims, 2 Drawing Sheets

GOLF BALL TEEING APPARATUS

The present invention relates to a teeing apparatus for golf balls. It is particularly intended for use in golf driving ranges and in a preferred form it is intended to provide a mechanism which is or can be mounted in the floor of a driving platform in a driving range.

Most golf practice ranges include a multiplicity of driving platforms which include a mat from which protrudes upwardly a fixed rubber tee, usually comprising an upright hollow rubber cylinder, on which a golf ball is manually placed and thereafter struck with a golf club. For many such platforms, there is an adjacent holder which usually holds a large multiplicity of golf balls that can be released one at a time on to the mat. The user must stoop to pick up the ball and place it on the rubber tee. The object of the present invention is to facilitate the teeing action.

The present invention is based on a teeing apparatus which comprises two carriers each of which supports a flexible tee adapted to support a golf ball for striking, and a mechanism linking the carriers and allowing alternate up and down movement thereof.

Preferably, the apparatus includes a support frame which comprises guides for the carriers. These guides may be hollow tubes extending down from a support plate. Such a support plate may be mounted immediately beneath a mat, which has apertures which accommodate the up and down movement of the carriers and the flexible tees, and to which balls can be delivered.

The mechanism may comprise a rocker arm which may be coupled, for example by means of a sliding pivot to each of the carriers. Each carrier may comprise a flanged cylindrical holder that serves as a mount for the respective flexible tee, which may comprise a short, hollow, elastomeric or polymeric cylinder.

A further feature of the invention comprises buffer springs each of which may support a respective carrier when the carrier is in a lowered position. Such a support spring enables the tee which is a raised position to be resiliently mounted in a vertical direction. The purpose of this arrangement is to reduce the susceptibility of the flexible tee to damage.

Reference hereinafter is made to the accompanying drawings, in which.

Figure 1:
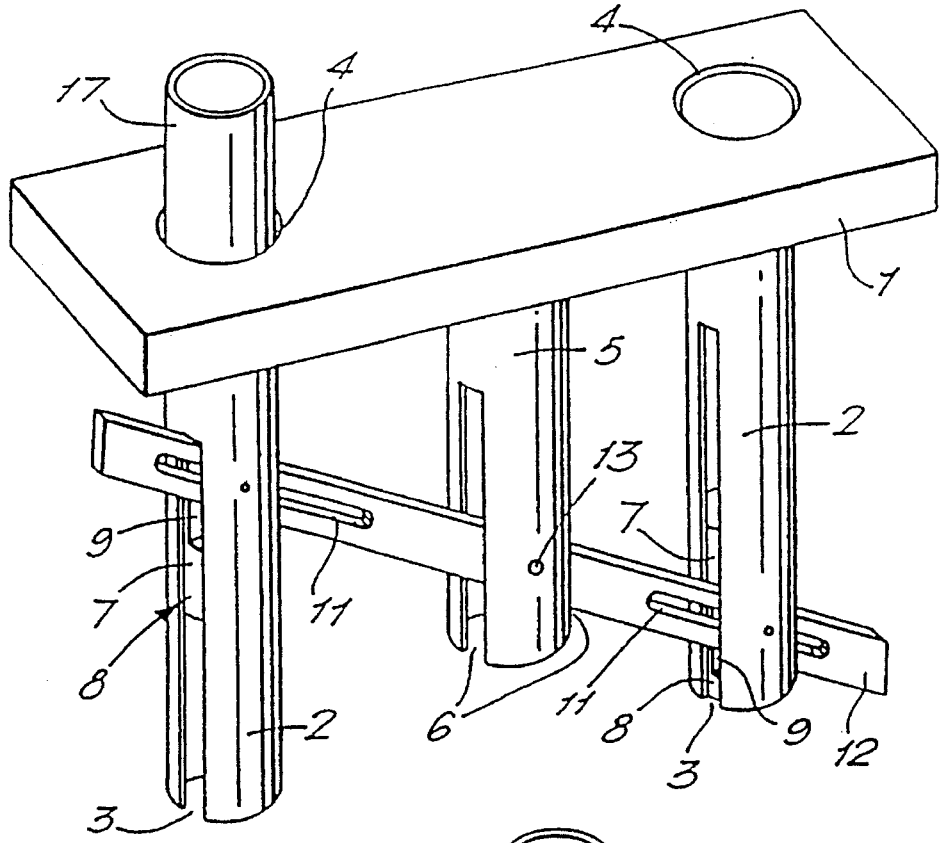
FIG. 1 is a perspective drawing of one embodiment of a mechanism according to the invention, showing a first tee in a raised position and a second tee in a lowered position.

The drawings illustrate one embodiment of the invention by way of example only. The embodiment shown in the drawings comprises a frame which in this embodiment includes a plate 1 that may be mounted horizontally in a manner shown in FIG. 3, beneath an apertured mat in a driving platform.

Depending from the plate 1 are two guides 2, which are preferably tubular in form. Each guide 2 has a pair of diametrically opposed longitudinal slots 3 extending from the bottom of each guide to a selected position near the top of each guide, for reasons to be explained.

The guides 2 are aligned with apertures 4 in the plate 1. These apertures are spaced apart by some convenient distance, which might typically be about 20 cm.

Between the locations of the guides 2 is a central pillar 5, likewise depending downwardly from the support plate 1. This pillar 5 is preferably in the form of a hollow tube and may have diametrically opposed longitudinal slots 6 extending upwards from the bottom of the pillar.

Within each of the guides 2 is a respective carrier 7 which includes a slider or piston 8 movable up and down within the respective guide 2. Each slider has a longitudinal central slot 9 across which extends a transverse pin (not shown) engaging a respective longitudinal slot 11 near one respective end of a rocker arm 12 which has a central pivot pin 13 mounted transversely of the central pillar.

Figure 3:
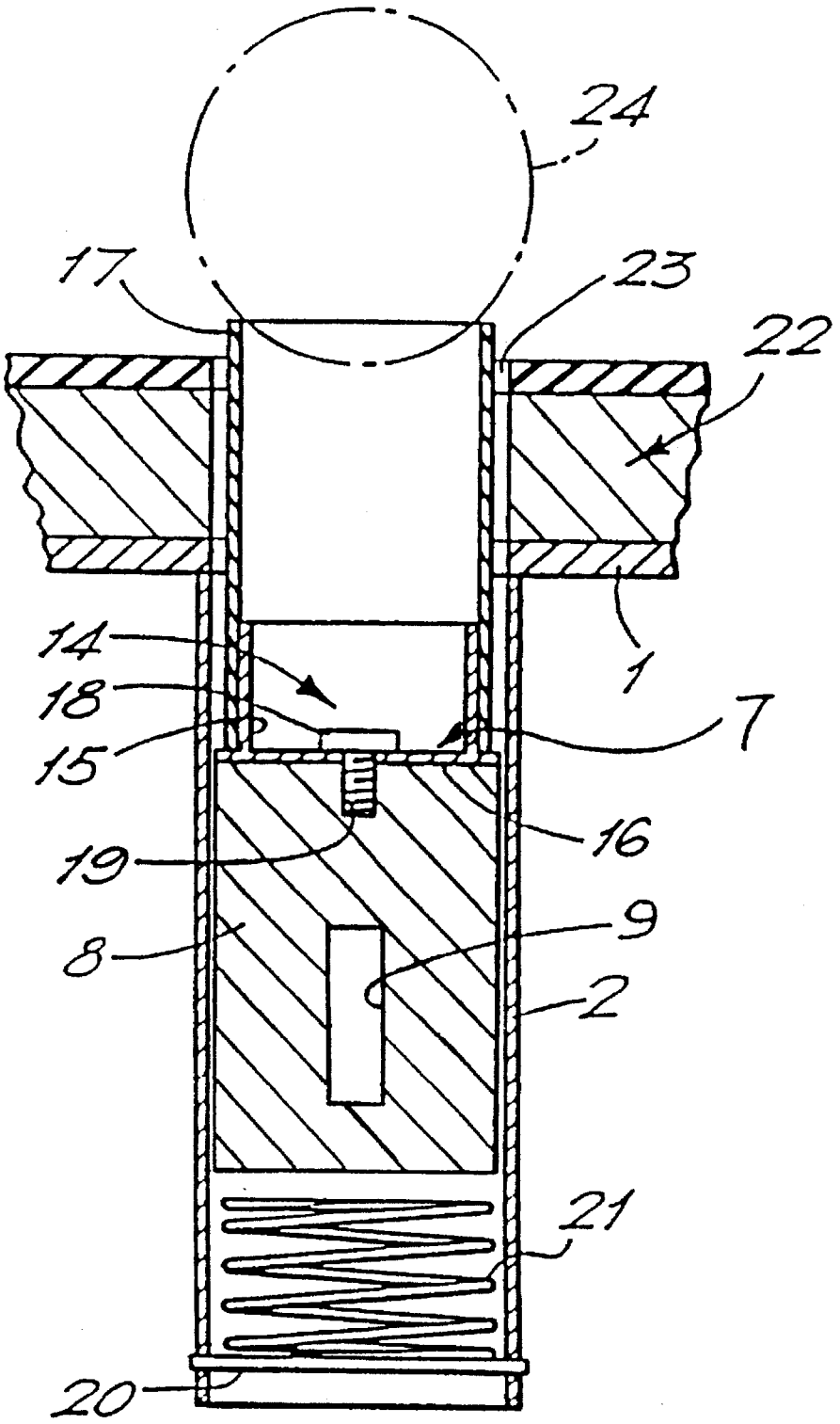
FIG. 3 is a sectional view of part of the mechanism shown in FIGS. 1 and 2 and includes an illustration of the mounting of the mechanism relative to a driving platform.

As is best shown in FIG. 3, each carrier includes a holder 14 which comprises a cylinder 15 having an end plate 16. A rubber cylindrical tee 17 is secured (such as by means of adhesive) to the cylinder 15. The assembly of the tee 17 and holder 14 may be removably secured by a screw 18 extending through the end plate 16 to a threaded bore 19 in the top of the slider 8.

At the bottom of each of the guides is a pin 20 extending diametrically across the guides, the pin supporting a respective helical spring 21.

Figure 2:
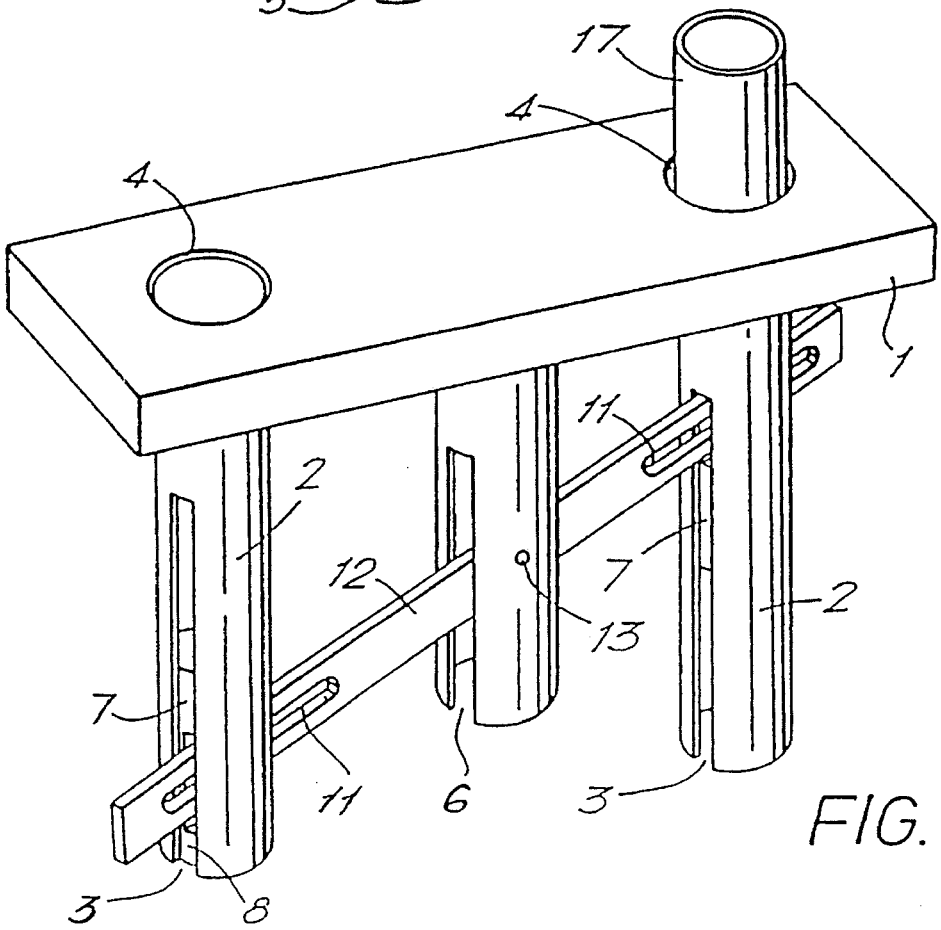
FIG. 2 is a perspective view of the mechanism shown in FIG. 1, the first tee being in a lowered position and the second tee being in a raised position.

As is shown in FIGS. 1 and 2, the arrangement of the mechanism and particularly the height of the slots in the tubular guides 2, is such that by pressing down with a foot or golf club on a raised one of the tees 17 the other tee may be raised to a position shown wherein the tee protrudes above the support plate. Thereby the tee is at a height convenient for the striking of a golf ball. If the support plate 1 were used to constitute, or be flush with, a playing surface, each new ball would may be placed on an aperture 4 above a lowered tee. Thus when a ball had been driven from a first tee, pressure on the first tee lowers the first tee and raises the second tee, which raises the ball that is on the respective aperture to a selectable height.

Although the apparatus could be used in that manner, a preferable arrangement is shown in FIG. 3, wherein the plate 1 is disposed underneath a mat 22 which has apertures, such as aperture 23, aligned with and broad enough to accommodate the tees and the up and down movement thereof. The apertures in the mat would therefore be, like the apertures in the plate 1, somewhat narrower than a standard golf ball. The maximum height for the top of the tee and the thickness of the mat may be selected according to preference. FIG. 3 shows in chain lines a golf ball 24 on a tee 17.

The present invention facilitates the teeing operation because a new ball can be directed to roll on to the aperture which is either in the support plate or, preferably, the mat above the support plate, the ball remaining there until it is raised by engagement with the tee that is raised when the other tee is depressed after the driving of the ball therefrom.

The cylindrical tees employed in driving ranges and employed in the preferred embodiment of this invention are liable to fracture by repeated stroke making. The life of the tees may be prolonged by the shock absorbent buffer constituted by the spring against which the lower tee rests when the upper tee is raised for the striking of a golf ball. FIG. 3 shows the carrier assembly in an intermediate position. Preferably, when the top of the rubber tee is level with the top surface of the mat, the bottom of the slider 8 of the carrier assembly rests on the spring 21.

I claim:

1. A golf teeing apparatus comprising two movable carriers (7) each of which supports a flexible tee (17) adapted to support a golf ball for striking, and a mechanism (2, 6, 12) linking the carriers and allowing alternate up and down movement thereof.

2. Apparatus according to claim 1, including a support frame which comprises guides (2) for the carriers.

3. Apparatus according to claim 2, wherein the support frame comprises a plate (1) from which the guides depend.

4. Apparatus according to claim 3, wherein the guides (2) comprise slotted tubes extending downwardly from the plate (1).

5. Apparatus according to claim 1, wherein the mechanism comprises a rocker arm (12) coupled by a sliding pivot (10, 11) to each of the carriers.

6. Apparatus according to claim 1, wherein there is a spring buffer (21) disposed to be engaged by a carrier (7) at a lower part of its movement, whereby the other carrier and the tee thereof are resiliently mounted.

7. Apparatus according to claim 6, wherein each tee (17) comprises a flexible hollow tube.

8. Apparatus according to claim 1, wherein each carrier (7) comprises a slider (8), a cylindrical holder (15) to which the respective flexible tee is secured, and means (16,18) for releasably securing the cylindrical holder to the slider.

9. A golf driving platform according to claim 1 and further comprising a mat (22) which has apertures (23) each accommodating a respective tee and the up and down movement thereof, each of the said apertures in the mat being capable of supporting a golf ball.

* * * * *